US011267545B2

(12) United States Patent
Sainato

(10) Patent No.: US 11,267,545 B2
(45) Date of Patent: Mar. 8, 2022

(54) HYDRODYNAMIC SPORT SNORKEL

(71) Applicant: Anthony D. Sainato, Stewart Manor, NY (US)

(72) Inventor: Anthony D. Sainato, Stewart Manor, NY (US)

( * ) Notice: Subject to any disclaimer, the term of this patent is extended or adjusted under 35 U.S.C. 154(b) by 122 days.

(21) Appl. No.: 16/526,136

(22) Filed: Jul. 30, 2019

(65) Prior Publication Data

US 2020/0039618 A1 Feb. 6, 2020

Related U.S. Application Data

(60) Provisional application No. 62/764,376, filed on Jul. 31, 2018.

(51) Int. Cl.

| | |
|---|---|
| ***B63C 11/20*** | (2006.01) |
| ***B63C 11/18*** | (2006.01) |
| *B63C 11/16* | (2006.01) |

(52) U.S. Cl.

CPC ..... *B63C 11/205* (2013.01); *B63C 11/186* (2013.01); *B63C 2011/165* (2013.01)

(58) Field of Classification Search

CPC ..... B63C 11/00; B63C 11/02; B63C 11/12; B63C 11/16; B63C 11/18; B63C 11/186; B63C 11/20; B63C 11/205; B63C 11/207; B63C 2011/165; A61B 9/00; A61B 9/06; A62B 9/00; A62B 9/06

USPC ..... 128/201.11

See application file for complete search history.

(56) References Cited

U.S. PATENT DOCUMENTS

| | | | | |
|---|---|---|---|---|
| 4,061,140 | A * | 12/1977 | Saito | B63C 11/207 128/201.11 |
| 4,230,106 | A | 10/1980 | Geeslin | |
| 4,878,491 | A | 11/1989 | McGilvray | |
| 4,896,664 | A | 1/1990 | Harayama | |
| 4,928,710 | A * | 5/1990 | Campbell | A62B 9/06 128/200.29 |
| 5,485,832 | A | 1/1996 | Joffity | |
| 5,697,362 | A | 12/1997 | Albrecht | |
| 6,073,626 | A * | 6/2000 | Riffe | B63C 11/205 128/201.11 |
| D501,044 | S | 1/2005 | Weigner | |
| D802,745 | S | 11/2017 | Ocklenburg | |
| D802,746 | S | 11/2017 | Ocklenburg | |
| D834,705 | S | 11/2018 | Evans | |

(Continued)

*Primary Examiner* — Colin W Stuart
(74) *Attorney, Agent, or Firm* — Phillips Nizer LLP

(57) ABSTRACT

An improved hydrodynamic sports snorkel for use in swim training, exercise and other recreational activities, which facilitates efficient swimming by eliminating the need for a swimmer to turn their head to the side for breathing. The sport snorkel device provides a novel design that significantly reduces drag and resistance, including by directing breathing tubes down the sides of the chin and under the jaw line toward the neck, around the neck and rejoining and going to the surface at the back of the neck behind the swimmer's head. This novel design with tubes running under the jawline and behind the head significantly reduces the portion of snorkel tubing directly in the water flow stream and thus reduces drag and resistance. The sport snorkel device also allows the swimmer to hold the snorkel solely by the mouthpiece without the need to fixedly attach the device to the swimmer's head or goggles.

14 Claims, 7 Drawing Sheets

(56) References Cited

U.S. PATENT DOCUMENTS

2006/0037607 A1* 2/2006 Trujillo ..... B63C 11/16
128/201.11
2006/0254582 A1* 11/2006 Christianson ..... A62B 9/02
128/201.11
2007/0131227 A1* 6/2007 Wheelwright ..... B63C 11/205
128/201.22
2007/0199565 A1* 8/2007 Ball ..... B63C 11/205
128/201.22
2007/0267012 A1* 11/2007 McCarthy ..... B29C 45/0013
128/201.11
2007/0272238 A1* 11/2007 Shiue ..... B63C 11/205
128/201.11
2010/0229858 A1* 9/2010 Wheelwright ..... B63C 11/205
128/201.11
2014/0331997 A1* 11/2014 Weigner ..... B63C 11/205
128/201.11
2015/0239537 A1* 8/2015 Calvillo ..... B63C 11/205
128/201.11
2017/0225756 A1* 8/2017 Pan ..... B63C 11/205

* cited by examiner

HYDRODYNAMIC SPORT SNORKEL

PRIORITY CLAIM

Applicant hereby claims priority under 35 USC § 119 to provisional U.S. patent application Ser. No. 62/764,376, filed Jul. 31, 2018, entitled "Sports Snorkel."

The entire contents of the aforementioned application are herein expressly incorporated by reference.

FIELD

The present innovations generally relate to a snorkel, and more particularly to a hydrodynamic sport snorkel useful in swim training, recreational snorkeling or the like. While discussed in the context of a sport swim training device below, the disclosure is not so limited and it will be understood to be useful in conjunction with other water activities.

BACKGROUND

When surface swimming for training, exercise or recreational snorkeling, swimmers expend a significant amount of effort breathing, particularly when swimming the most common freestyle stroke. Traditional single tube snorkels running along one side of the head are difficult to use because in swimming at speed there is significant drag on only one side of the head causing strain.

More recent single tube snorkel designs known as "full face snorkels" have a tube that runs up the center of the swimmers face—from the mouth, over the nose, between the eyes, and over the forehead where it exits the water and is attached via a head-strap to the swimmer. While these snorkels reduce the asymmetric drag issues posed by side tube snorkels, full face snorkels interfere with vision, causes significant drag and are not stable as the swimmer moves through the water since the majority of the snorkel is exposed to the full force of the water stream when swimming at speed.

Others have designed a variety of dual tube snorkels with a tube extending along both the left and right side of the swimmer head, such as that disclosed in U.S. Pat. Nos. 5,697,362, 4,878,491 and U.S. Pat. No. D802,745. While these devices distributed the drag more evenly by creating a dual tube design with essentially equal drag on both sides of the head, they significantly increased overall drag as they wrap around the swimmer's head at or near its widest point and with tubes oriented at an angle almost perpendicular to the onrushing water when swimming at speed. In addition, they are unstable as they break the water, requiring them to be securely attached to the swimmer's head, goggles or mask.

Previous designs are cumbersome, uncomfortable, obstructive and cause significant drag. Additionally, the drag from these snorkels makes the snorkels shake and move in the onrushing water. This vibration and irregular movement can cause pain in the swimmer's mouth as the mouthpiece presses against the gums.

For the forgoing reasons, there is a need for an improved hydrodynamic sports snorkel that is simple to use, reduces drag and does not need to be strapped to the swimmer's head.

SUMMARY

The present disclosure solves the above needs and deficiencies with known swim snorkel devices including by providing a novel tube shape that reduces the portions of the snorkel exposed to the water flow stream, reduces drag on snorkel portions in the water flow stream and removes the need for fixing the snorkel to the swimmer's head. In conjunction with these improvements the present disclosure includes a dual tube swim snorkel that extends from both side of a mouthpiece and bends sharply downward over the sides of the swimmer's chin and under the jawline. From there the dual tubes extend under both sides of the jawline toward the neck. At the neck the dual tubes each then curve outward around opposite sides of the neck and curve back together at the back of the neck where they preferably join and extend upward so that the tube exits at the water surface above the back of the neck. Optimal fit will have the re-connection point rest on the base of the swimmer's neck/top of the back, between the shoulders, when the swimmer bends his/her neck to look forward through the water. In various alternate embodiments of the disclosure, the snorkel tubes are preferably almond shaped with an apex or pointed side of the almond shape situated to face into the direction of the water flow. In yet other embodiments, the snorkel may also be adapted with a hydrodynamic mouthpiece guard to further reduce the drag where the mouthpiece guard is shaped to smooth waterflow over the mouthpiece area when the swimmer is swimming. In yet other embodiments, the snorkel may be adapted with purge values to eliminate water that has entered the snorkel and/or a float valve or splash guard at the exhaust tube surfaced to reduce water entry from the surface tube opening.

While the disclosure above and the detailed disclosure below is presented herein in the context of sport snorkel, it will be understood by those of ordinary skill in the art that the concepts may be applied to other types of water activities in various ways where there is a beneficial advantage to reduce drag. With the foregoing overview in mind, specific details will now be presented, bearing in mind that these details are for illustrative purposes only and are not intended to be exclusive.

BRIEF DESCRIPTION OF THE DRAWINGS

The accompanying drawings illustrate various non-limiting examples and innovative aspects of the sport snorkel in accordance with the present description.

DETAILED DESCRIPTION

Figure 1:
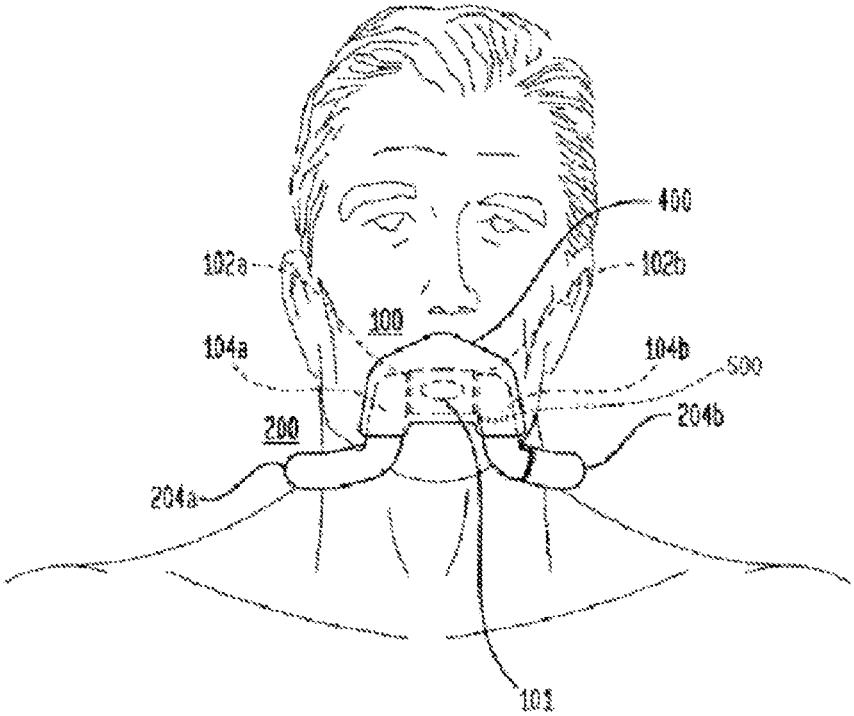
FIG. 1 shows a front view of one embodiment of the hydrodynamic sport snorkel.
Figure 2:
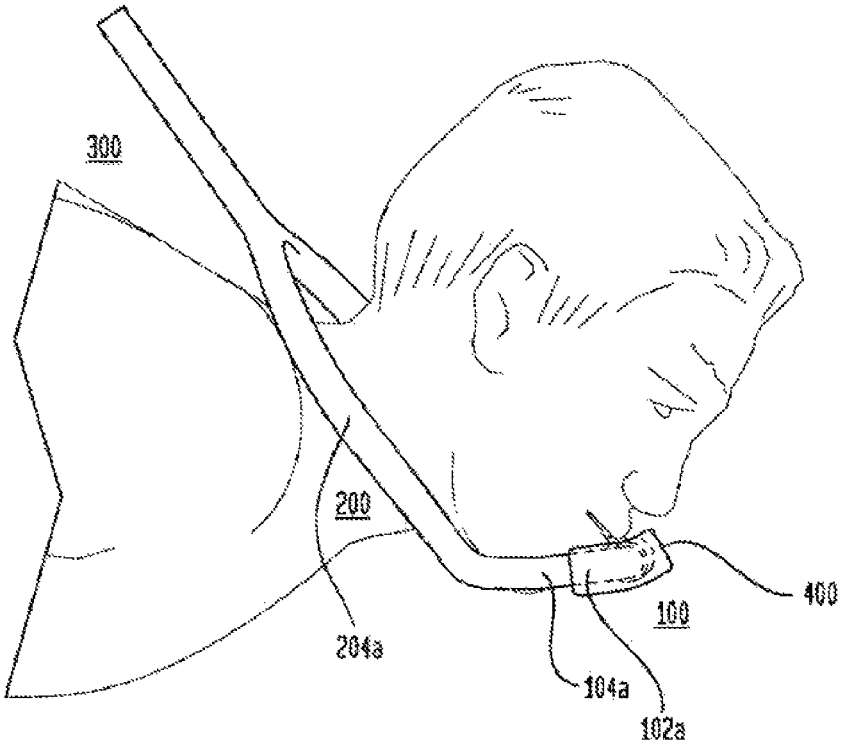
FIG. 2 shows side view of one embodiment of the hydrodynamic sport snorkel.
Figure 3:
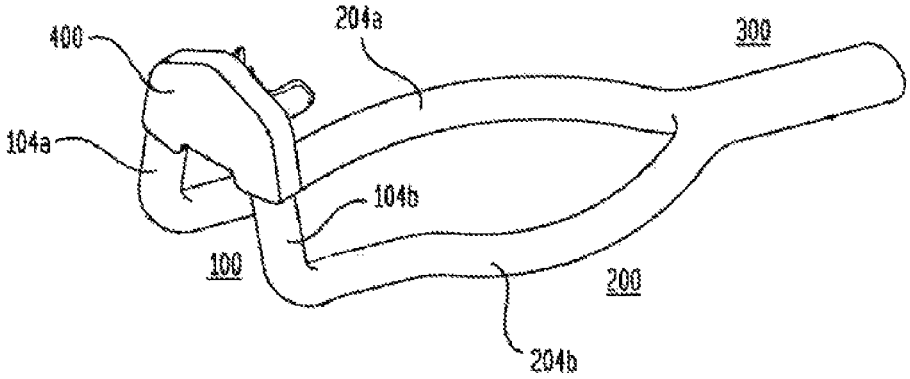
FIG. 3 shows a top view of one embodiment of the hydrodynamic sport snorkel.
Figure 4:
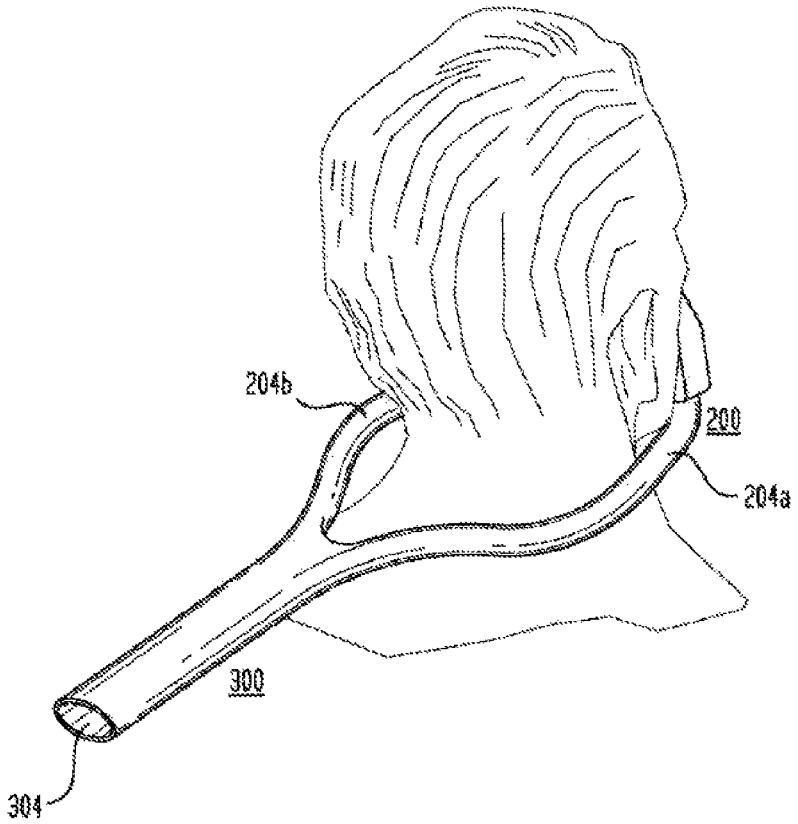
FIG. 4 shows an isometric rear side view of one embodiment of the hydrodynamic sport snorkel.

In simplified overview, an improved sport snorkel useful for water activities including exercise, swim training and recreational snorkeling is described herein. The disclosed hydrodynamic sport snorkel is designed to be used by swimmers and is described in detail with respect to swim training. Those skilled in the art will however understand that the novel attributes of the disclosure are useful in a multitude of other endeavors including other recreational such as those described above as well as in professional and military roles.

As a swimmer using the freestyle stroke (face down, body straight along the top of the water, neck bent up "looking forward" through the water; the swimmer extends each arm alternatively above the head and pulls water along and beneath the body, with legs kicking alternatively, to propel the swimmer) moves forward, the swimmer's head breaks the water at or near the hairline. This is the area of greatest water resistance. Water resistance is less under the jaw and around the neck as water that is moved aside by the head of an active swimmer will swirl around the head and pool beneath the head. Water resistance is least behind the head of the swimmer at the bottom of the neck as water swirls around the head and is pushed forward by the swimmer's shoulders. The hydrodynamic sport snorkel disclosed herein reduces resistance and drag through the novel placement of the snorkel tube in these areas of lower water-resistance.

Specifically, in disclosed embodiments, the novel overall shape of the disclosed hydrodynamic sport snorkel is adapted to substantially follow the contours of the swimmer's face and neck from the mouth, continuing under the mouth down the sides of the chin, along the underside of the jaw and then around the neck, reconnecting behind the swimming's neck and extending out of the water to an opening at the top of the swimmer's back between the shoulders thereby allowing the swimmer to breath freely. Optimal fit will have the re-connection point rest on the base swimmer's neck/top of the back, between the shoulders, when the swimmer bends his/her neck to look forward through the water.

This novel design creates a more hydrodynamic, stable, comfortable snorkel, giving the swimmer a full range of motion when employing the most commonly used freestyle stroke. In certain embodiments the hydrodynamics may be further improved using almond, tear drop or other hydrodynamic shaped tubing to reduce drag. In other embodiments the design also includes a mouthpiece guard to add a hydrodynamic profile to the mouthpiece.

The features of the disclosed sport snorkel are discussed in further detail below in conjunction with the figures. As described in the disclosure below the description provides tube angles with respect to a coordinate system oriented through the mouthpiece, wherein a horizontal z-axis passes through the mouthpiece perpendicular to the plane of a swimmer's face (i.e. into the swimmer's face/mouth), a horizontal x-axis perpendicular to the z-axis is in the plane of the swimmer's face (i.e., parallel with a swimmer's mouth), and a vertical y-axis perpendicular to the x-axis and z-axis is in the plane of the swimmer's face. In this reference coordinate system, the xy plane is a plane parallel with the mouthpiece and swimmer's face (the face plane), the yz plane vertically bisects the snorkel and the swimmer's face (i.e., the snorkel tubes are symmetric around the yz plane; the symmetry plane)), and the horizontal xz plane bisects the mouthpiece and swimmer's mouth (the horizontal plane). While specific details of the shape and angles of the hydrodynamic sport snorkel are provided by example with respect this Cartesian coordinate system and for an "average" sized adult swimmer, it will be understood by those of skill in the art that the sport snorkel can be scaled for various sizes and will come in a children's size and small, medium and large adult size, and measurements can be tailored appropriately.

Referring to FIGS. 1 through 4, the hydrodynamic sports snorkel comprises three primary portions—a mouthpiece portion 100, a neck portion 200 and a surface extension portion 300.

Starting at the mouth, the mouthpiece portion 100 preferably comprises a soft silicon bite portion 101, a left and right lateral extension tubes 102*a* and 102*b*, and left and right chin extension tubes 104*a* and 104*b*.

The sport snorkel may preferably use a silicon bite portion 101 similar to traditional snorkels. For example, the bite portion will comprise a semi-circular lip portion that will be disposed between a swimmer's upper and lower lip and teeth, protrusion portions that extend in a direction into the swimmers mouth and centered so that the swimmer can bit down on an hold the silicon bite portion in their mouth, and a center hole or lumen for airflow in and out of the swimmer mouth through the silicon bite portion to the snorkel tubing.

In a typical adult sized snorkel, for example, the bite portion 101 may extend 0.25 inches into the swimmer's mouth and then continue in a semi-circle that is 0.25 inches wide, 0.75 inches tall and follows the rows of teeth in the swimmer's mouth in a semi-circular fashion for 3 inches allowing the swimmer to bite down on it and "hold" the sport snorkel in place. The center of this section will be hollow having a lumen allowing the flow of air and this lumen may be preferably almond shaped and 1 inch wide and 0.5 inches high or alternatively circular of similar cross-sectional area. The hollow section of the mouthpiece will start inside the mouth, behind the teeth and continue forward out of the mouth until it is beyond the swimmer's lips about 0.5 inches.

Figure 5A:
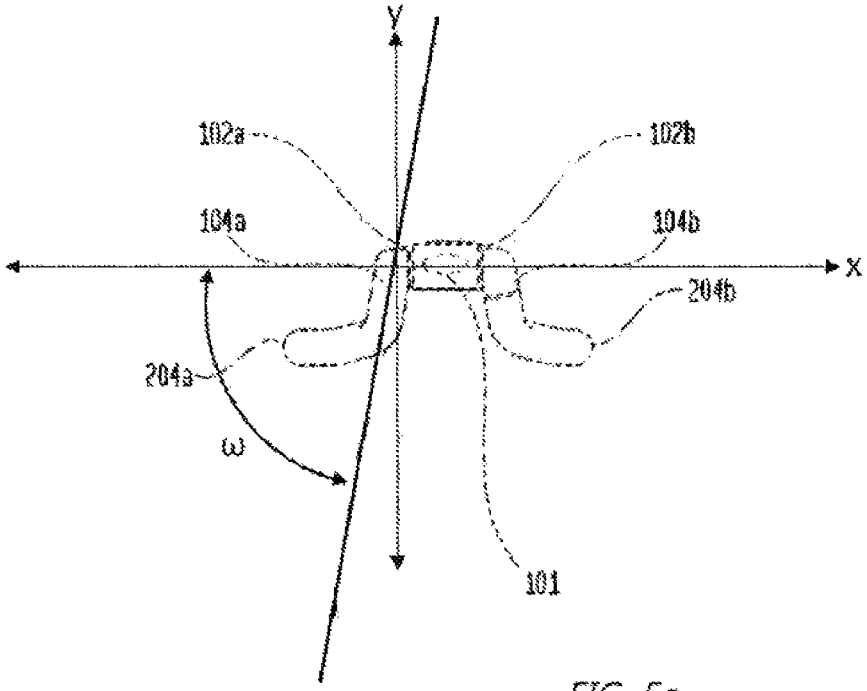
FIGS. 5*a*-5*e* show front, side and isometric views of one embodiment of the hydrodynamic sport snorkel with tube angles with respect to a Cartesian coordinate system.
Figure 5B:
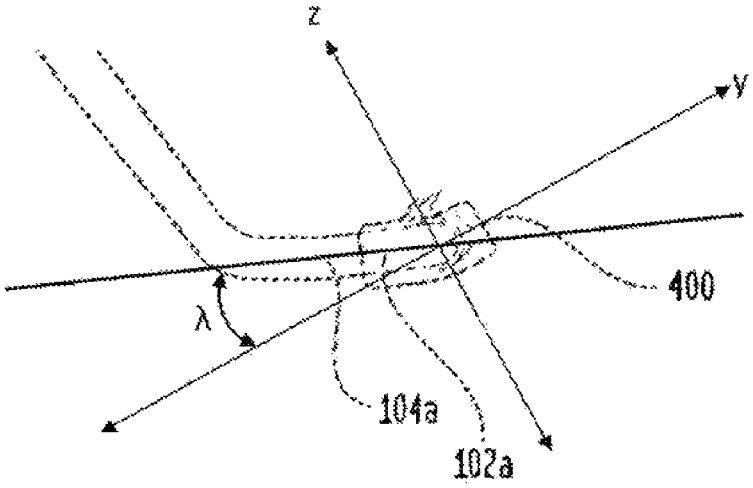
Figure 5C:
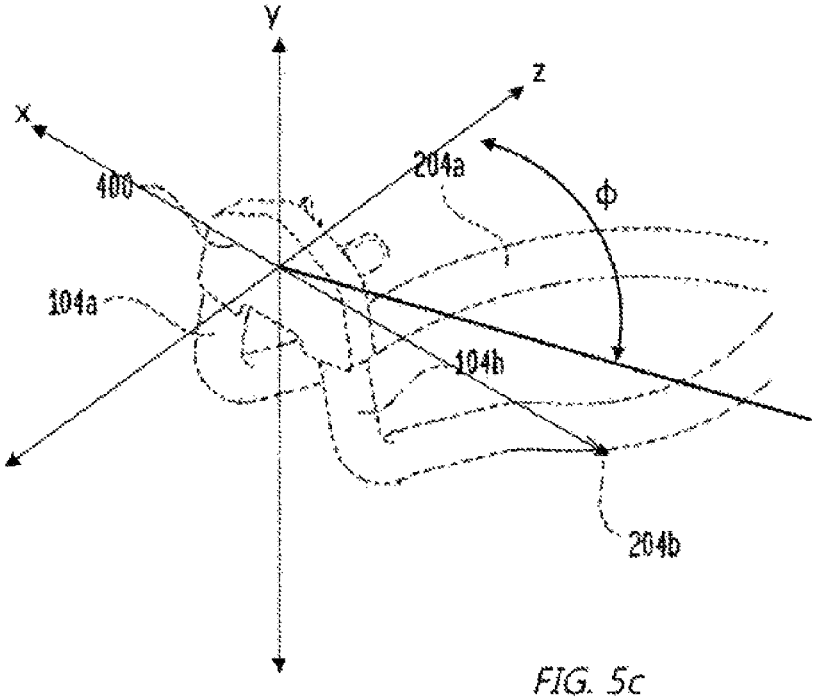

At this point, the silicon bite portion 101 will connect with the left and right lateral extension tubes 102*a*, 102*b* which extend in a direction substantially along the x-axis at about an 80 to 90 degree angle Φ with respect to the yz plane (FIG. 5*c*) to the left and right of the center of the bite portion in the form a T-shape. The lateral extension tubes 102*a*, 102*b* each having lumens in fluid communication with the lumen of the silicon bite portion 101.

The left and right lateral extension tubes 102*a*, 102*b* may be of any cross-sectional shape but will preferably have a cross-section in an almond, droplet or round shape (for less water resistance) and of similar dimensions described earlier. Preferably, for example, the almond shape tubing will be oriented so that one of the "pointed" ends will be directed into the water flow stream when a swimmer is swimming; i.e., the long side of the almond shape in a plane parallel to the plane of the swimmer's face or so that the longer part runs parallel to the swimmer's face (in the face plane) and the shorter part extends away from the face. Similarly, in a droplet-shaped cross-section the head of the drop would preferably be facing upward toward the swimmer's nose and the tail of the droplet would be toward the swimmer's lower lip.

Figure 5D:
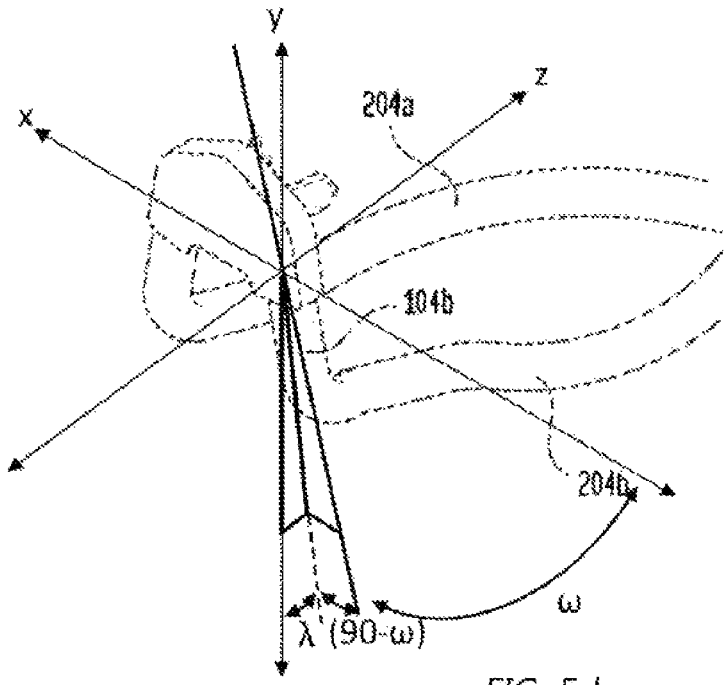

In the almond shaped tubing example, the lumen or hollow section may preferably have a cross-sectional dimension of approximately 0.75 inches deep and 1 inch wide. The left and right lateral extension tubes 102*a*, 102*b* preferably extend approximately 2.5 inches together (1.25 inches to the left and right of the center of the mouth) to the corners of the swimmer's mouth. At the corners of the mouth the left and right lateral extension tubes turn downward (substantially in the direction of the y-axis) at an angle co with respect to the xz plane (see FIGS. 5*a* and 5*d*) between 75 and 85 degrees and preferable about 80 degrees into left and right chin extension tubes 104*a*, 104*b* which preferably extend about 2.25 inches along opposite sides the swimmer's face to the bottom of the swimmer's chin or jawline. In this configuration the left and right chin tubes are preferably splayed outward from the from they axis at an angle of between 5 to 15 degree (i.e., 90−ω) or preferably 10 degrees (see FIGS. 5*a* and 5*d*). The left and right lateral extension tubes may also turn slightly backward (in the direction of the z-axis) at an angle λ with respect to the xy plane (see FIGS. 5*b* and 5*d*) so that the left and right chin extension tubes are directed down the face at a slight angle toward the back of the head, wherein the angle is preferably between 0 and 15 degrees.

At the bottom of both sides of the chin, the sport snorkel's left and right chin extension tubes 104 *a*, 104 *b* turn at an angle Ω with respect to the xy plane (see FIG. 5*e*) to extend under the swimmer's jawline toward the neck portion 200. The angle Ω is preferably between 60 and 80 degrees and preferably about 65 degrees, so that an angle between the left and right chin extension tubes and left and right jawline extension tubes, respectively, is an obtuse angle. In some alternate embodiments, the angle Ω may approach 90 degrees. In other alternate embodiments of the invention, the sport snorkel may be adapted with purge valves at the end of the left and right chin extension tubes 104 *a*, 104 *b*, so that the swimmer may readily expel water should it enter the sport snorkel tubes by accident.

Figure 5E:
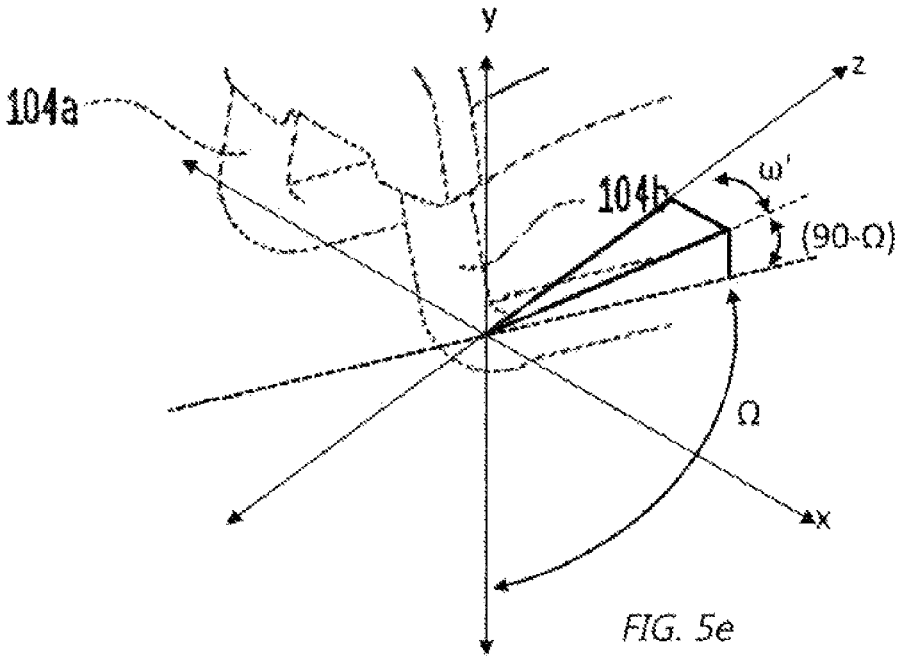

The neck portion 200 begins with the left and right jawline extension tubes, extending under the swimmer's jawline and toward the swimmer's neck while maintaining a trajectory away from the jawline (e.g., away from the xz plane) at an angle Ω and away from center (e.g., away from the yz plane) at an angle ω' which is preferable within plus or minus five degrees of, or matched to, the angle (90−ω) from the turn at the mouth, which is preferably about 10 degrees (see FIG. 5*e*). The left and right jawline extension tubes extend approximately 1 to 2 inches on both sides where it will connect to corresponding left and right curved neck extension tubes 204*a*, 204*b* and begin to curve outward and around the swimmer's neck while continuing also in a downward direction toward the swimmer's shoulders as the tubes progress around the swimmer's neck. In order to circle the neck, the sport snorkel will be shaped to wrap around an imaginary cylinder with a approximately 18 inch circumference, representing the swimmer's neck.

The left and right curved neck extensions 204*a*, 204*b* will continue around the swimmer's neck from both sides until they meet behind the swimmer's neck. This meeting point will be approximately 3.25 inches further down the swimmer's neck relative to where it started its circular curve so that the meeting point is at the base of the swimmer's neck at the top of the back. Here the left and right curved neck extension tubes 204*a*, 204*b* of the sport snorkel may reconnect into the surface extension portion 300.

The surface extension portion 300 will preferably extend for about 4.25 inches away from the swimmer's body toward the water surface. The surface extension portion is preferable reclined at a 45 to 55 degree angle relative to the swimmer's back and in one embodiment at a 50 degree angle. In alternate embodiments, the left and right curved neck extension tubes 204*a*, 204*b* may join so that the surface extension tube 300 may be a single tube or alternatively the neck extension tubes may not rejoin and the surface extension tube 300 may comprise two adjacent tubes. The angle on the surface extension portion will lessen water resistance as opposed to if the sport snorkel were to run perpendicular to the swimmer's body (90 degree angle). The surface extension portion 300 may also have an almond or droplet shaped cross section to reduce resistance. At this portion of the sport snorkel, the almond or droplet shaped cross section is preferably oriented so that one point of the almond or head of the droplet is facing into the water flow stream (e.g., toward the swimmer head), and the other end of the almond or tail of the droplet is facing toward the swimmer's shoulders or back.

At its end the surface extension portion 300 is open 304 to allow air intake. In alternate embodiments the snorkel surface opening 304 may also be capped with a splash guard and/or float valve to help prevent water from entering through the top of the tube.

The sport snorkel can be composed of material a PVC plastic with a rubbery feel (as are most snorkels) that is pliant enough to allow it to flex and bend as the swimmer moves through the water yet rigid enough to maintain integrity of the tube allowing for unimpeded airflow while causing it to return to its original shape. Also, the sport snorkel may be flexible enough to allow the swimmer to put on and take off the sport snorkel by pulling the circular section outward (to the swimmer's left and right) enabling the sport snorkel to slide over the swimmer's head.

While the tubes of the sport snorkel are described in separate sections above (e.g., mouthpiece portion 100, neck portion 200 and surface portion 300), it will be understood by those skilled in the art that the tubing may be integrally molded, extruded, or separately molded sections fused, glued or otherwise joined, and the different portions may have different rigidity or flexibility. For example, the mouthpiece portion may preferably be more rigid than the neck portion so that swimmers can better hold the sport snorkel in place with their mouth while have some flexibility in the neck portion for some bending in the water flow and for taking the sport snorkel on and off.

The materials for the sport snorkel however shall be rigid enough so that the snorkel need not be strapped to or attached to the swimmer, but rather can be held in place by the swimmer biting on the mouthpiece. Proper fit will have the sport snorkel resting on the top of the swimmer's back/neck at the point of re-attachment as the swimmer bends his/her head to look forward. When the swimmer's head is straight ("normal" position for a person standing or sitting erect), the point of re-attachment will be above the back and the only contact with the swimmer is at the mouthpiece. When swimming, the snorkel may also contact with the back/neck which will allow the sport snorkel to remain stable and comfortable during active swimming.

While various dimensions are given above for each portion of the sport snorkel, these represent just one example of a snorkel fitting for an adult and these dimension should all be understood to be variable within a range of about plus or minus ten percent and also to greater percentages to scale for child and other sized sport snorkels so long as the arrangement is such that the tubing runs under the swimmer's jawline and around the neck to reduce drag and resistance.

Mouthpiece Guard

In alternated embodiments, the sport snorkel may also include a mouthpiece guard to further enhance the hydrodynamics.

The area where the disclosed sport snorkel will likely encounter the greatest water-resistance as the swimmer moves through the water is the area of the mouthpiece portion 100 (the neck portion 200 under the chin and around the neck to the and surface extension portions 300 on the swimmer's back will encounter significantly less resistance according to the disclosure and as explained above). To mitigate this water-resistance, in certain embodiments the hydrodynamic sport snorkel may also include an attached guard 400 that covers the mouthpiece and extends over the sport snorkel mouthpiece portion 100. This piece will preferably also be made of PVC plastic and be firmer than the rest of the sport snorkel.

The mouthpiece guard 400 will preferably be like a rectangle that is missing one of its longer sides. The one longer side of the guard will be on top of this section of the sport snorkel and the two shorter sides of the guard will run toward the swimmer's face and cover the mouthpiece portion 100 almost completely. The guard will be approximately 1.1 inches wide and 0.6 inches deep. The edges of the guard will be slightly curved to help with water resistance.

The top of the mouthpiece the guard 400 will extend in a triangle-like fashion toward the swimmer's nose for approximately 0.2 inches and will taper down the face to where it reaches the corners of the mouthpiece. Under the mouthpiece. the guard will extend down the swimmer's face for an additional approximately 0.25 inches. In this extended area below the mouthpiece guard 400 will be flat and may not curve back toward the swimmer's face. Extending the guard 400 to a point above the mouthpiece and as a flat top below the mouthpiece will lessen water resistance.

Detachment Area

The sport snorkel may also be configured with a detachment area 500 where it can pull apart in the event that the sport snorkel gets caught on something and detach and/or be used as a means of facilitating the putting on and removal of the snorkel. The "area of detachment" may be in various areas but is preferably provided at an area between the right or left lateral extension tube and right or left chin extension tube, or along the right or left chin extension. For example, the area of detachment may be on the right or left chin at the point after the extension so the pieces can be separated even with a mouthpiece guard 400 in place.

Within the area of detachment, one tube will preferably be sized to slide into the other tube portion so that the tubes can be slid together and removably connected. The connection is preferably using a friction fit or coupling that will come apart with an appropriate amount of pull force. For example, an annular bump and annular detent arrangement may be used where the inside of a receiving section near the open end will be one or more small annular detents around the interior circumference of the tube lumen and the insertion section will have two corresponding annular bumps or protrusions on the exterior circumference of the tube. These annular bumps or protrusions may preferably be raised 0.075 inches and be 0.1 inches wide with correspondingly size and positioned detents for receiving the protrusions. The one annular bump may preferably be about 1.15 inches from the open end of the tube, and a second annular bump may preferably be about 1.4 inches from the open end. The bumps may be made of the same material as the tubing or made of the more soft "gummy" PVC plastic. The connection will be sufficiently tight and sealed to remain attached and waterproof with normal use.

The swimmer will be able to detach/reattach the sport snorkel by holding the guard or mouthpiece portion with one hand and the chin extension tube or jawline extension tube with the other hand. The swimmer can then pull the two points away from one another and once enough force is applied to overcome the tension from the stretching of the receiving section and to pull the bumps of the insertion sections past the detents of the receiving section, the tubes will detach. Similarly, should the sport snorkel become caught on some object, it will detach and separate once minimal force is applied.

It should be understood that this description (including the figures) is only representative of some illustrative embodiments. For the convenience of the reader, the above description has focused on representative samples of all possible embodiments, and samples that teach the principles of the disclosure. The description has not attempted to exhaustively enumerate all possible variations. That alternate embodiments may not have been presented for a specific portion of the disclosure, or that further undescribed alternate embodiments may be available for a portion, is not to be considered a disclaimer of those alternate embodiments. One of ordinary skill will appreciate that many of those undescribed embodiments incorporate the same principles of the disclosure as claimed and others are equivalent.

What is claimed is:

1. A sport snorkel comprising:

A mouthpiece portion, a neck portion and a surface portion;

the mouthpiece portion having a center bite portion, a left lateral extension tube, a right lateral extension tube, a left chin extension tube and a right chin extension tube, the bite portion configured to be received and held in a swimmer's mouth, and having a mouthpiece lumen for air passage configured to pass air in and out of a swimmer's mouth, the left lateral extension tube and the right lateral extension tube are configured to extend laterally across a swimmer's mouth, the left and right lateral extension tubes each having a lumen in fluid communication with the mouthpiece lumen and;

the left chin extension tube connected to the left lateral extension tube and the right chin extension tube connected to the right lateral extension tube, the left chin extension tube having a lumen in fluid communication with the lumen of the left lateral extension tube and the right chin extension tube having a lumen in fluid communication with the lumen of the right lateral extension tube, wherein the left chin extension tube is configured to extend in a direction from a left side swimmer's mouth to a left side of a swimmer's chin and the right chin extension tube is configured to extend in a direction from a right side of a swimmer's mouth to a right side of a swimmer's chin;

the neck portion having a left jawline extension tube and a right jawline extension tube, a left curved neck extension tube and a right curved neck extension tube, the left jawline extension tube connected to the left chin extension tube and the right jawline extension tube connected to the right chin extension tube, the left jawline extension tube having a lumen in fluid communication with the lumen of the left chin extension tube and the right jawline extension tube having a lumen in fluid communication with the lumen of the right chin extension tube, wherein the left jawline extension tube is configured to extend from a left side of a swimmer's chin under a bottom left side of a swimmer's jaw toward a left side of a swimmer's neck and wherein the right jawline extension tube is configured to extend from a right side of a swimmer's chin under a bottom right side of a swimmer's jaw toward a right side of a swimmer's neck;

the left curved neck extension tube connected to the left jawline extension tube and the right curved neck extension tube connected to the right jawline extension tube, the left curved neck extension tube having a lumen in fluid communication with the lumen of the left jawline extension tube and the right curved neck extension tube having a lumen in fluid communication with the lumen of the right jawline extension tube, and wherein the left and right curved neck extension tubes are configured to extend from a front portion of a swimmer's neck and curve around a swimmer's neck to a back area of a swimmer's neck, and wherein the left and right curved neck extension tubes are configured to meet at an area at the back of the swimmer's neck;

the surface portion comprises at least one surface extension tube connected at a first end to the left and right curved neck extension tubes and having a lumen in fluid communication with the lumens of the left and right curved neck extension tubes, and the at least one surface extension tube having a second free-end open to the lumen of the at least one surface extension tube whereby the at least one surface extension tube is configured to draw air in and expel air from the lumen of the at least one surface extension tube, and wherein the at least one surface extension tube is configured to extend away from a back area of a swimmer's neck;

wherein each of the tubes has a tear drop shape; and wherein the mouthpiece portion is adapted to receive a mouthpiece guard having a substantially rectangular shape with an top edge and two lower corners, and the top edge is configured to extend 0.2 inches from the mouthpiece portion towards the nose and the two lower corners are configured to extend 0.25 inches down the swimmer's face.

2. The sport snorkel of claim 1, wherein the center bite portion, left lateral extension tube, right lateral extension tube, left chin extension tube and right extension chin tube of the mouthpiece portion are in the form of a u-shape with splayed legs wherein the center bite portion, left lateral extension tube and right lateral extension tube form the base of the u-shape and the left and right chin extension tubes form the splayed legs each splayed at an angle of between 5 and 15 degrees from a vertical plane of symmetry bisecting the left and right lateral extension tubes and an angle between 0 and 10 degrees from a vertical face plane perpendicular to the vertical plane of symmetry.

3. The sport snorkel of claim 2, wherein the right chin extension tube and left chin extension tube are splayed at angle of 10 degrees.

4. The sport snorkel of claim 2, wherein the left jawline extension tube and right jawline extension tube are connected to the left chin extension tube and right chin extension tube respectively, at an angle of between 60 and 80 degrees from a vertical face plane, whereby an angle between the left and right chin extension tubes and left and right jawline extension tubes, respectively, is an obtuse angle.

5. The sport snorkel of claim 4, wherein the left jawline extension tube and right jawline extension tube are connected to the left chin extension tube and right chin extension tube respectively, at an angle of 65 degrees from a vertical face plane.

6. The sport snorkel of claim 1, wherein at least one of the left or right chin extension tubes is composed of a receiving portion or an insertion portion, wherein the insertion portion is sized to be inserted inside the receiving portion and wherein a friction fitting removably holds the insertion portion inside the receiving portion.

7. The sport snorkel of claim 6, wherein the friction fitting is composed of at least one mating annular bump and annular detent.

8. The sport snorkel of claim 1, wherein at least one of the left or right lateral extension tubes is composed of a receiving portion or an insertion portion, wherein the insertion portion is sized to be inserted inside the receiving portion and wherein a friction fitting removably holds the insertion portion inside the receiving portion.

9. The sport snorkel of claim 8, wherein the friction fitting is composed of at least one mating annular bump and annular detent.

10. The sport snorkel of claim 1, wherein right and left chin extension tubes each have a purge valve.

11. The sport snorkel of claim 1, wherein the surface portion includes a splash guard at an opening to the at least one surface extension tube.

12. The sport snorkel of claim 1, wherein the surface portion includes a float valve at an opening to the at least one surface extension tube.

13. The sport snorkel of claim 1, wherein the surface portion is a single surface extension tube.

14. A sport snorkel comprising a mouthpiece portion, a neck portion and a surface extension portion:

the mouthpiece portion having an upside down u-shape wherein a silicon bite portion is configured to be held in a swimmer's mouth and is connected to a left and right lateral extension tubes that form a base of a u-shape, the left and right lateral extension tubes being connected to a left and right chin extension tubes, respectively, which each form a leg of the u-shape, whereby the u-shaped mouthpiece portion is configured to extend from a swimmer's mouth over each side of a swimmer's chin to a swimmer's jawline;

the neck portion having a left and right jawline extension tubes and a left and right curved neck extension tubes, the left and right jawline extension tubes connected to the left and right chin extension tubes, respectively, and configured to extend under a swimmer's jawline toward a swimmer's neck, and connect to the left and right curved neck extension tubes, respectively, the left and right curved neck extension tubes configured to curve around from a front side of a swimmer's neck to a back side of a swimmer's neck, the surface extension portion having at least one surface extension tube configured to connected to the left and right curved neck extension tubes at the back of a swimmer's neck and configured to extend away from a swimmer's back to surface opening in the at least one surface extension tube;

the mouthpiece portion, neck portion and surface extension portion each having a lumens therethrough in fluid communication whereby the silicon bite portion is configured to pass air to and from the surface opening;

wherein each of the tubes has a tear drop shape; and wherein the mouthpiece portion is adapted to receive a mouthpiece guard having a substantially rectangular shape with an top edge and two lower corners, and the top edge is configured to extend 0.2 inches from the mouthpiece portion towards the nose and the two lower corners are configured to extend 0.25 inches down the swimmer's face.

* * * * *